US012629601B2

(12) United States Patent
Kamiyama

(10) Patent No.: US 12,629,601 B2
(45) Date of Patent: May 19, 2026

(54) TOY FOR FIGURE PLAY

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 101 days.

(21) Appl. No.: 18/383,966

(22) Filed: Oct. 26, 2023

(65) Prior Publication Data

US 2024/0139636 A1 May 2, 2024

(30) Foreign Application Priority Data

Oct. 27, 2022 (JP) ..... 2022-172174

(51) Int. Cl.
*A63H 3/52* (2022.01)
*A63H 17/26* (2006.01)

(52) U.S. Cl.
CPC ..... *A63H 3/52* (2013.01); *A63H 17/262* (2013.01)

(58) Field of Classification Search
CPC ..... A63H 3/52; A63H 17/262; A63H 33/003; A63H 33/42
See application file for complete search history.

(56) References Cited

U.S. PATENT DOCUMENTS 5,299,527 A 4/1994 Grossman
6,257,947 B1 * 7/2001 Glaser ..... A63H 33/003 446/72
2008/0081536 A1 * 4/2008 Payne ..... A63H 33/42 446/75
2008/0143966 A1 6/2008 Mastrosimone-Gese et al.
2012/0045965 A1 * 2/2012 Zhou ..... A63H 3/52 446/478

FOREIGN PATENT DOCUMENTS

JP S61-094100 U 6/1986
JP S62-155899 U 10/1987
JP H06-269576 A 9/1994
JP 3116131 U 11/2005

OTHER PUBLICATIONS

Japanese Office Action issued Mar. 24, 2026 in Application No. 2022-172174.

* cited by examiner

*Primary Examiner* — Thomas M Sember

(74) *Attorney, Agent, or Firm* — Faegre Drinker Biddle & Reath LLP

(57) ABSTRACT

A toy for figure play includes a guide portion, a first slide member, a second slide member, and an interlocking member. The first slide member is configured to be guided by the guide portion, and includes a first knob portion and a first display portion. The second slide member is configured to be guided by the guide portion. The second slide member is provided on a back side of the first slide member, and includes a second knob portion. The interlocking member is provided to be movable in accordance with a slide operation of the second slide member, and includes a second display portion disposed on a front side of the first display portion.

7 Claims, 18 Drawing Sheets

TOY FOR FIGURE PLAY

CROSS-REFERENCE TO RELATED APPLICATIONS

This application is based on and claims priority under 35 USC 119 from Japanese Patent Application No. 2022-172174 filed on Oct. 27, 2022, the contents of which are incorporated herein by reference.

TECHNICAL FIELD

The present disclosure relates to a toy for figure play.

BACKGROUND ART

Traditionally, in a figure play played by children such as infants, the figure play is sometimes performed while imagining the scene. As toys to make the imagination of the scene more concrete, toys for figure play, which have shapes imitating a building such as a house, a hospital, a school, or a vehicle such as a car, an airplane, and a bus, are provided. To assist a change in the scene and an image, some of the toys for figure play are equipped with a display portion on which characters, designs, and the like can be displayed and the display can be changed. JPS62-155899U discloses a toy for figure play that imitates the hospital. The toy for figure play is provided with the display portion for displaying a state of the hospital and the patient.

SUMMARY OF INVENTION

The display portion in the related art described above can be enjoyed by changing the display in conjunction with other members. In recent years, it may be possible to use an electrically driven display device (for example, liquid crystal, LED, and the like) to enjoy the change in display, but manual operation may be enjoyable for children such as infants.

An object of the present disclosure is to provide a toy for figure play for which manual operation for changing the display is enjoyable.

The present disclosure provides a toy for figure play including: a guide portion; a first slide member configured to be guided by the guide portion, the first slide member including a first knob portion and a first display portion; a second slide member configured to be guided by the guide portion, the second slide member being provided on a back side of the first slide member and including a second knob portion; and an interlocking member provided to be movable in accordance with a slide operation of the second slide member, the interlocking member including a second display portion disposed on a front side of the first display portion.

According to the present disclosure, it is possible to provide the toy for figure play for which the manual operation for changing the display is enjoyable.

BRIEF DESCRIPTION OF DRAWINGS

The present disclosure will be described in detail based on the following without being limited thereto, wherein.

DESCRIPTION OF EMBODIMENTS

Figure 1:
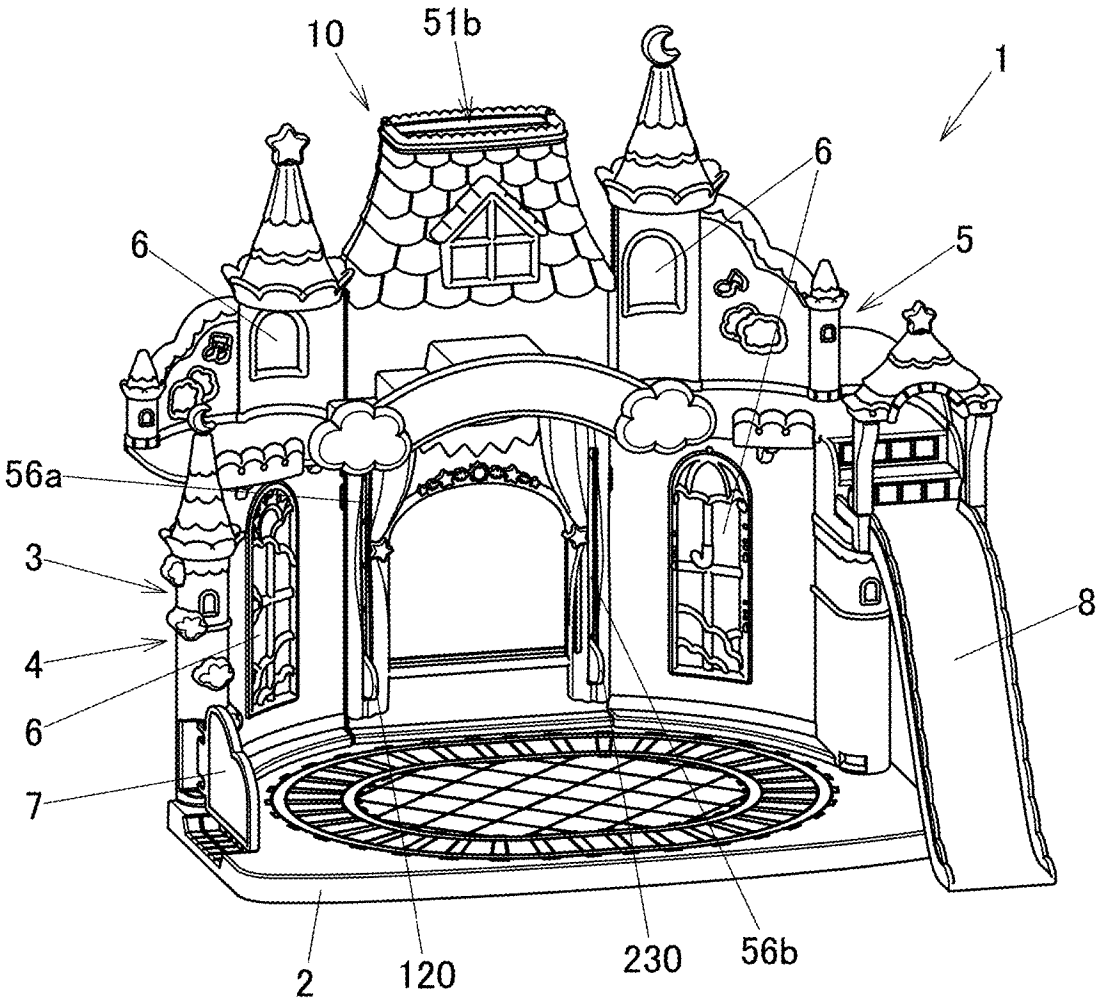
FIG. 1 is a perspective view of a toy for figure play according to an embodiment of the present disclosure.

Embodiments of the present disclosure will be described based on the drawings. A toy for figure play 1 is formed so that the toy for figure play 1 can be played with while imagining a nursery school using a plurality of small figures.

The toy for figure play 1 includes a flat plate-shaped base member 2 formed by imaging an indoor floor. A panel member 3 formed by imaging a building of the nursery school is provided on an upper surface of the base member 2. The panel member 3 is formed in a curved shape and is disposed near an edge of the upper surface of the base member 2 to surround a part of the base member 2.

In the following description, a front side of the panel member 3 will be referred to as a front surface, the opposite side thereof will be referred to as the rear or a back surface, an upper surface of the base member 2 will be referred to as the top, and the opposite side thereof will be referred to as the bottom. The description will be made by referring a left side and a right side when viewing the toy for figure play 1 from the front as the left and the right, respectively.

The panel member 3 is provided with a substantially flat plate-shaped display portion 10 in a central part thereof. The panel member 3 includes a left panel portion 4 and a right panel portion 5 that curve and extend leftward and rightward, respectively, from the display portion 10. Each of the left panel portion 4 and the right panel portion 5 is formed in a two-story shape, and is provided with a plurality of open window portions 6. The left panel portion 4 is provided with a door portion 7 formed by imaging a door for entering the nursery school. The right panel portion 5 is provided with a slide 8 that can be slid down from a second floor.

Figure 2:
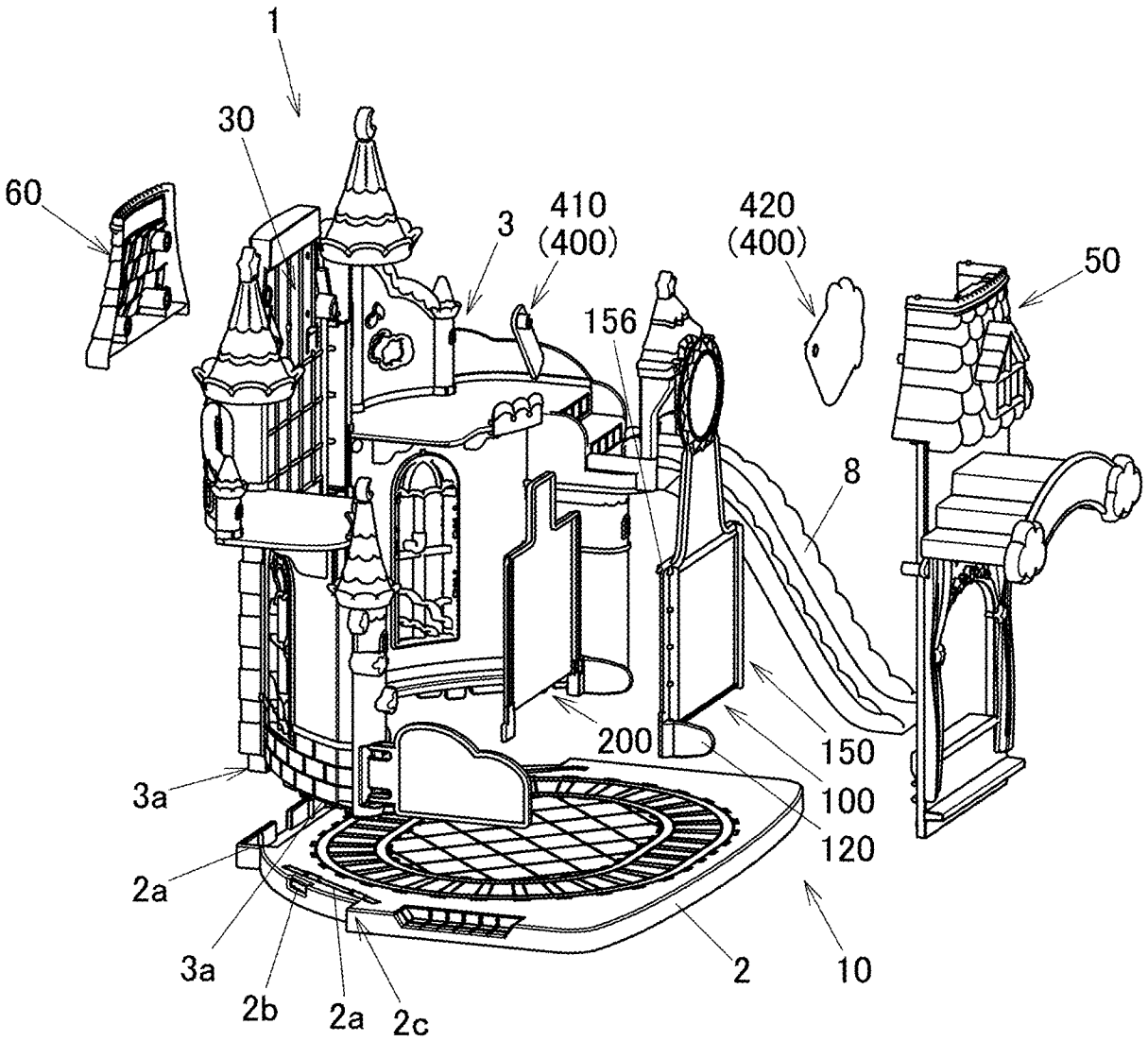
FIG. 2 is an exploded perspective view of the toy for figure play according to the embodiment of the present disclosure.

FIG. 2 illustrates the display unit 10 in an exploded manner, and illustrates the panel member 3 and the base member 2 in an exploded manner. The panel member 3 and the base member 2 are connected by a plurality of protruding portions 3*a* of the panel member 3 and a plurality of recess portions 2*a* of the base member 2 engaging each other in a protrusion-recess manner. The display portion 10 includes a cover member 50, a first slide member 100, a second slide member 200, an interlocking member 400, and a planar guide portion 30 formed on the panel member 3.

Figure 3:
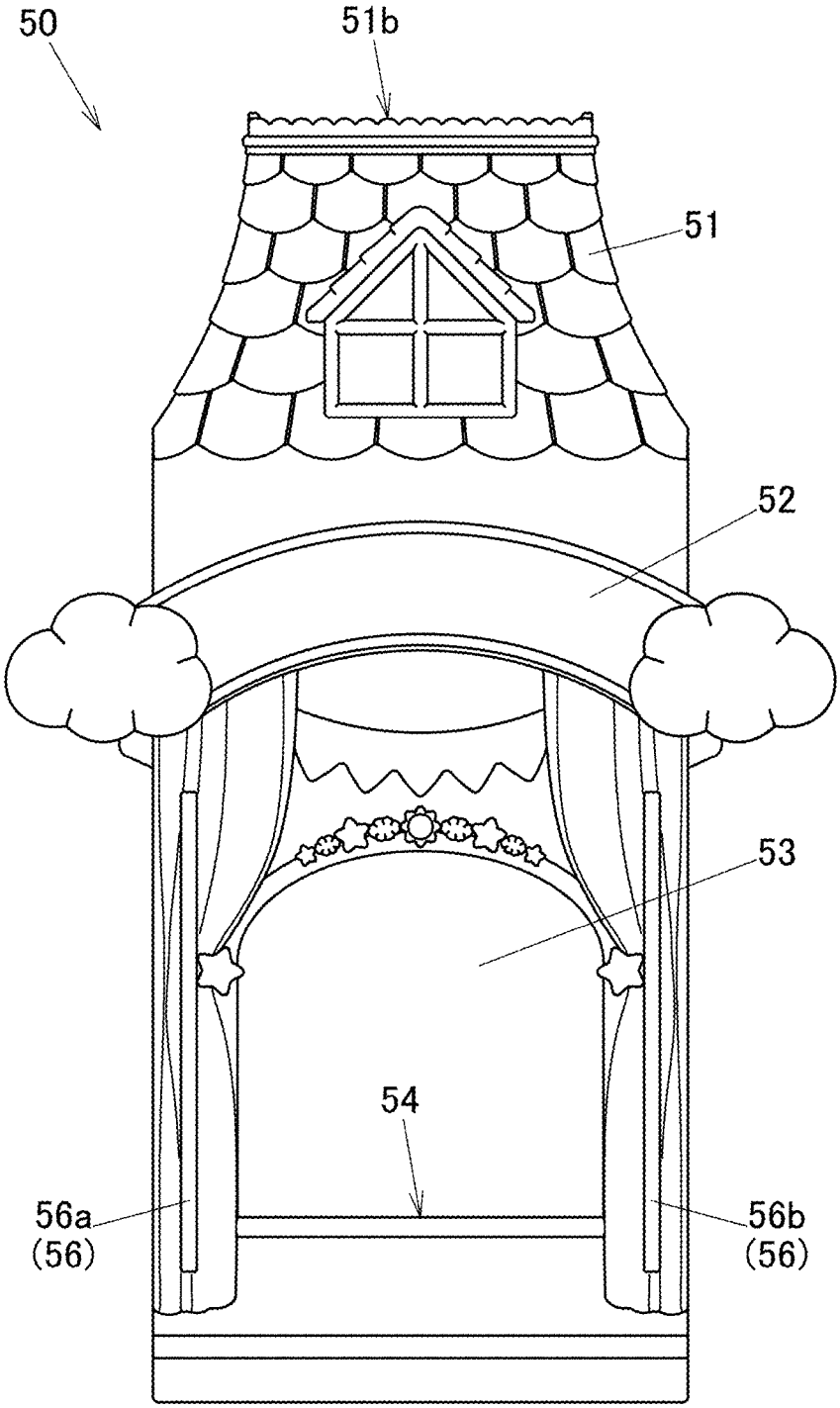
FIG. 3 is a front view of a cover member of the toy for figure play according to the embodiment of the present disclosure.
Figure 4:
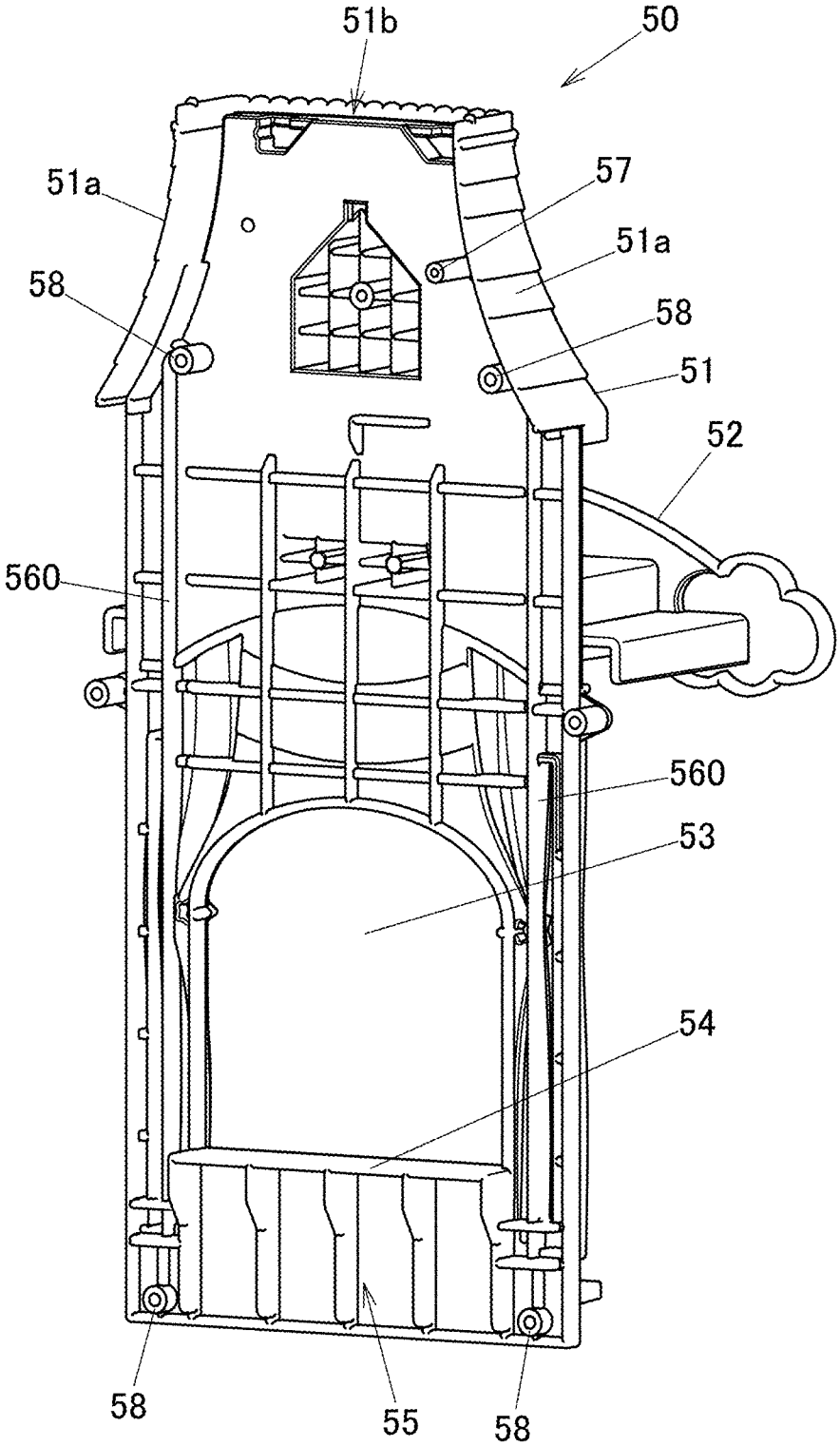
FIG. 4 is a perspective view of a back surface of the cover member of the toy for figure play according to the embodiment of the present disclosure.

As illustrated in FIGS. 3 and 4, the cover member 50 is formed in a substantially flat plate shape that is long in the vertical direction and narrows at an upper part thereof. The cover member 50 is provided with a roof portion 51 on the upper part. As illustrated in FIG. 4, the roof portion 51 is provided with concavely curved side plates 51*a* on the left and right side surfaces thereof. A rear roof portion 60 (see FIG. 2) is attached to a rear side of the roof portion 51. An upper end between the side plates 51*a* is formed as an appearing/disappearing opening part 51*b*, and is opened in the vertical direction with the rear roof portion 60 attached thereto.

As illustrated in FIG. 3, the cover member 50 is provided with a decorative portion 52 formed that looks like a rainbow hanging between two clouds on a lower side of the roof portion 51 on the front side. A display window portion 53 that opens in a front and rear direction is provided on a lower side of the decorative portion 52. As illustrated in FIG. 4, at a lower end of the display window portion 53, a regulating horizontal plate 54 whose plate surfaces are oriented in the vertical direction is provided. A plurality of vertical ribs 55 extending in the vertical direction are provided on a lower surface of the regulating horizontal plate 54. The decorative portion 52 can also be a separate part.

Guide slits 56 (left guide slit 56*a*, right guide slit 56*b*) (guide portion) which open in a slit shape that is long in the vertical direction are provided on the left and right of the display window portion 53 of the cover member 50, respectively.

Figure 5:
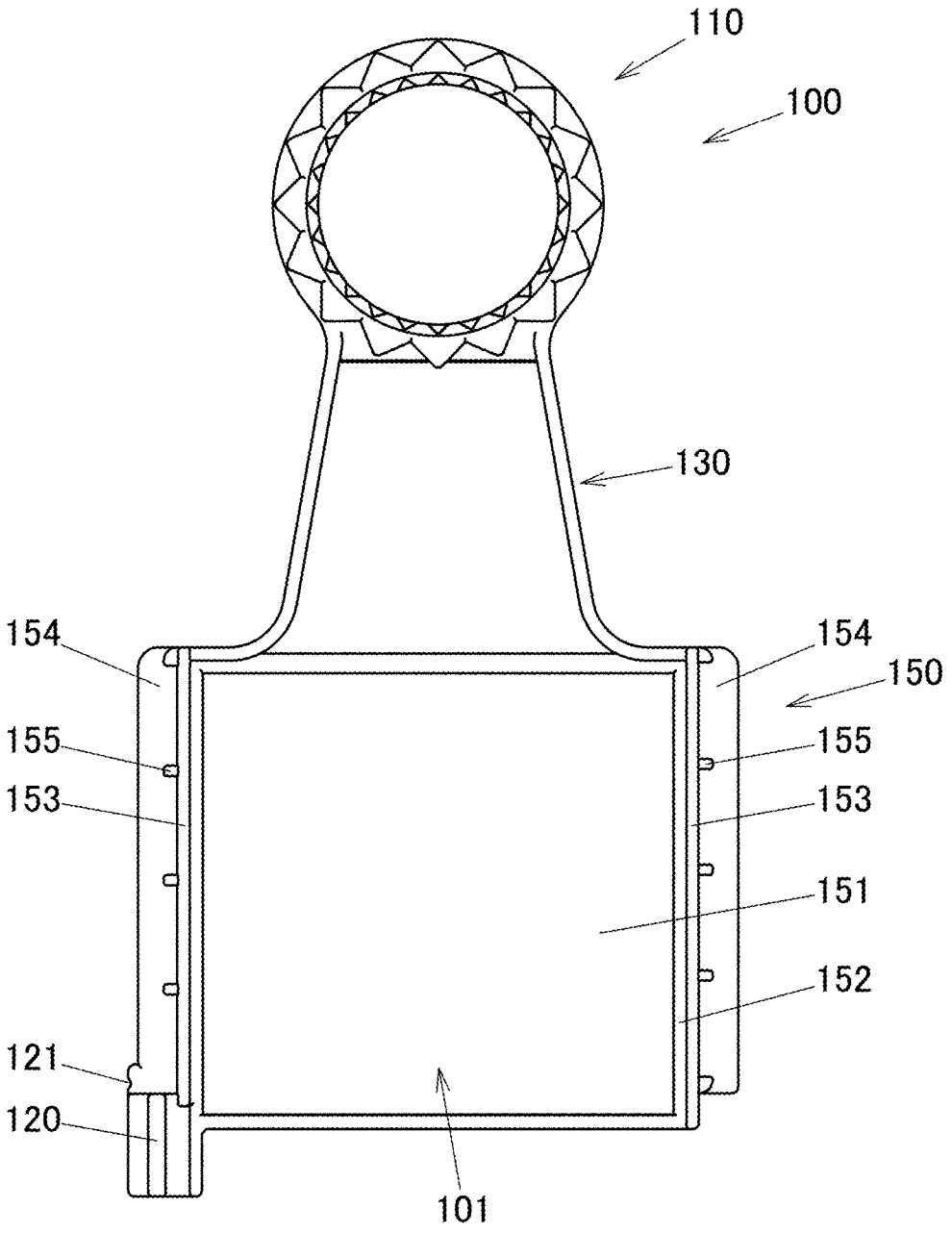
FIG. 5 is a front view of a first slide member of the toy for figure play according to the embodiment of the present disclosure.

As illustrated in FIG. 5, the first slide member 100 is formed in a substantially flat plate shape with plate surfaces thereof facing in the front and rear direction, and includes a main body portion 150, a support plate portion 130 extending upward from the main body portion 150, and a disk-shaped first display portion 110 provided at the tip of the support plate portion 130. The main body portion 150 has a substantially rectangular shape that is slightly long in the left and right direction, and includes a flat plate portion 151 whose front surface serves as a first sub-display portion 101. An outer edge of the flat plate portion 151 is provided with an annular stepped portion 152 that has a substantially rectangular and annular shape and protrudes slightly to the front side beyond a surface of the flat plate portion 151 (first sub-display portion 101) (see also FIGS. 9 and 10).

A wall-shaped guided wall portion 153 is provided on the outside of each annular stepped portion 152. On the back side of each guided wall portion 153, a substantially rectangular flap portion 154 that is long in the vertical direction is provided to project outward. In other words, the guided wall portion 153 and the flap portion 154 are formed to have an L-shaped cross portion. The guided wall portion 153 and the flap portion 154 are orthogonal to each other, and a plurality of (three on each of right and left sides) guide ribs 155 are provided on the front side of a connecting portion therebetween.

The left flap portion 154 protrudes beyond the lower end of the flat plate portion 151. On the front of a portion where the left flap portion 154 protrudes downward, a plate-shaped first knob portion 120 whose tip part has a semicircular shape and which is erected with plate surfaces thereof facing the left and right direction is provided. A first engaging portion 121 is provided on the left flap portion 154 directly above the first knob portion 120. The first engaging portion 121 is a recess portion formed in a recess shape from an edge of a portion slightly wider than the left flap portion 154.

Figure 8:
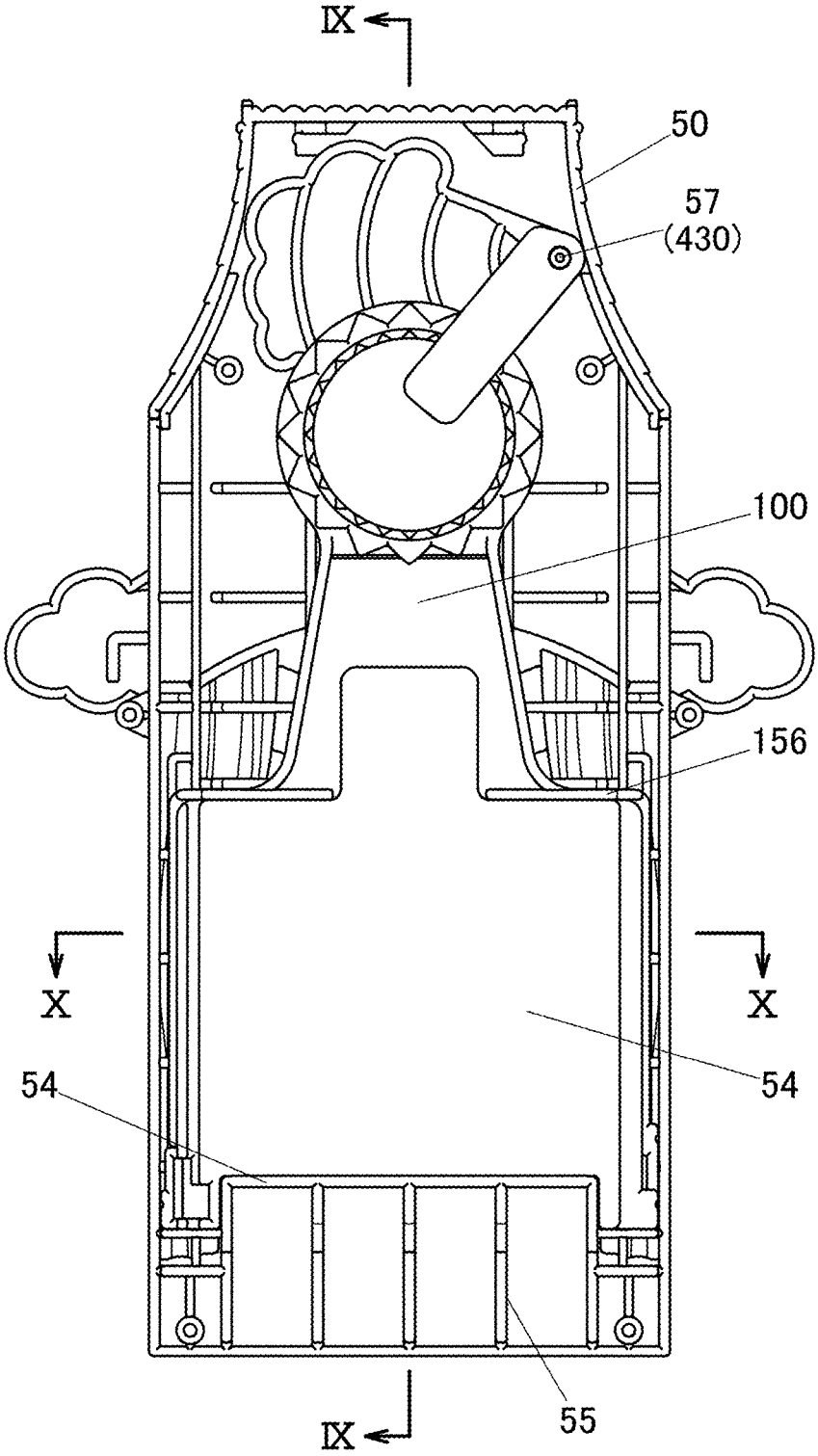
FIG. 8 is a back view of a display portion of the toy for figure play according to the embodiment of the present disclosure with a panel member omitted, illustrating a state in which both the first slide member and the second slide member are positioned at a lower limit position.

As illustrated in FIGS. 2 and 8, an engaging abutting portion 156 is provided at the upper end on the back side of the main body portion 150. As illustrated in FIG. 8, the engaging abutting portion 156 protrudes for a short length rearward from the back surface of the main body portion 150 with plate surfaces thereof facing in the vertical direction, and is intermittent at a substantially central part in the left and right direction. As illustrated in FIG. 5, the support plate portion 130 is formed in a substantially trapezoidal shape. In the embodiment of the present disclosure, the first display portion 110 is provided with a pattern representing the sun.

Figure 6:
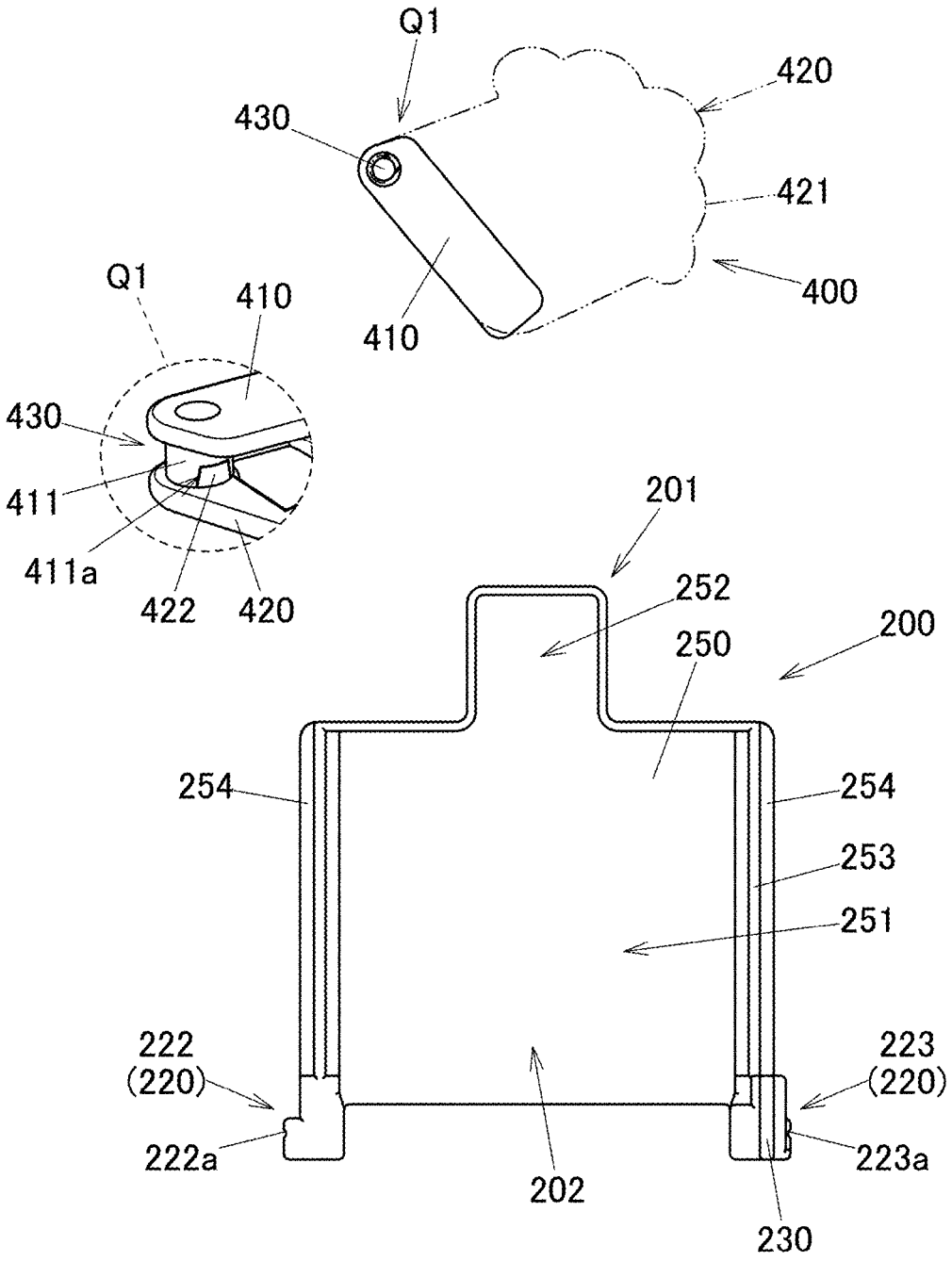
FIG. 6 is a front view illustrating a second slide member and an interlocking member of the toy for figure play according to the embodiment of the present disclosure.

As illustrated in FIG. 6, the second slide member 200 is formed in a substantially flat plate shape with the plate surfaces thereof facing in the front and rear direction. The second slide member 200 is provided with a protruding portion 201 having a protruding shape on the upper side thereof. The second slide member 200 includes a main body portion 250 having a protruding shape, in other words, is provided with a large rectangular portion 251 and a small rectangular portion 252. Here, the front surface of the large rectangular portion 251 formed as a flat surface is a second sub-display portion 202. On the left and right edges of the large rectangular portion 251, rectangular flap portions 254 that are long in the vertical direction are provided on the left and right sides, respectively.

Figure 10:
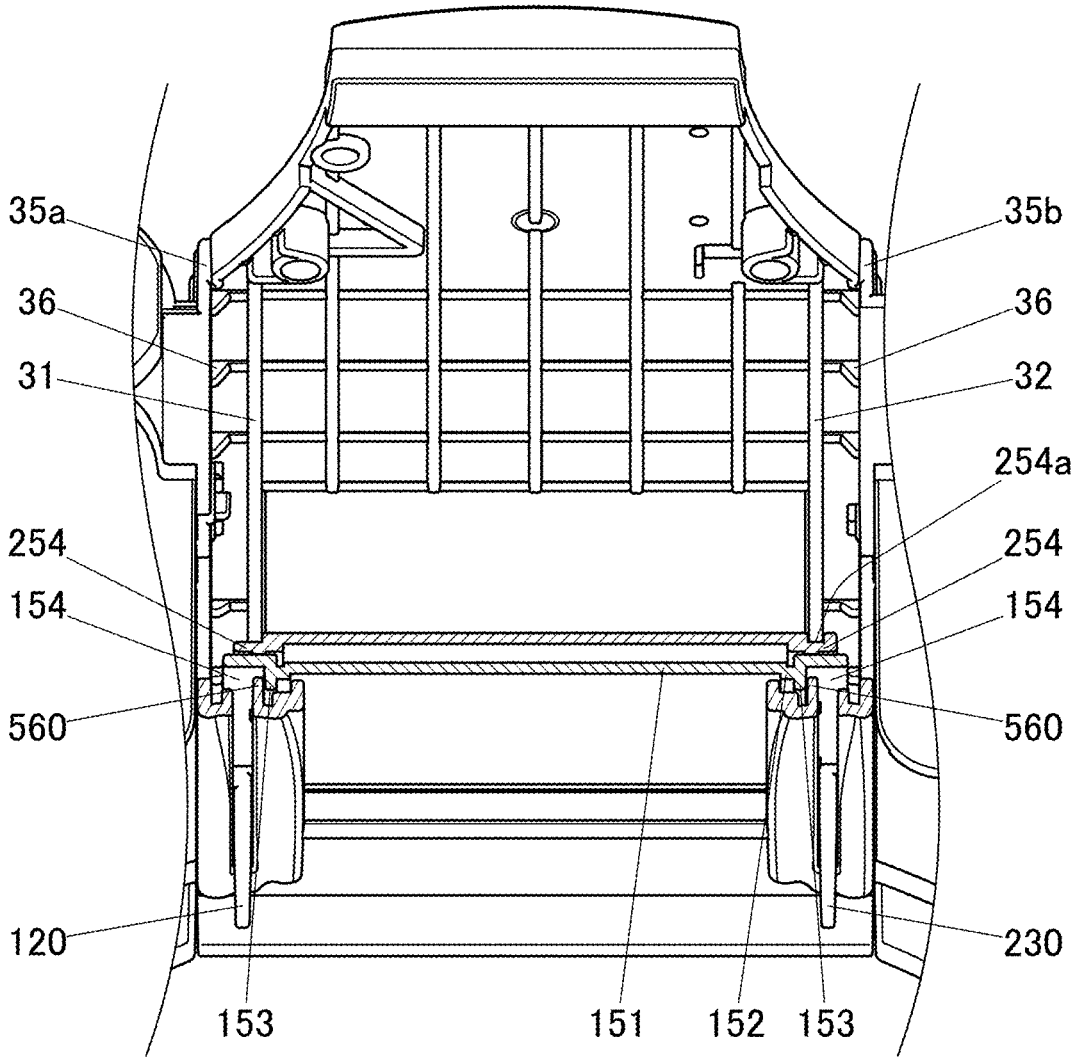
FIG. 10 is a cross-sectional perspective view of the toy for figure play when viewed from a front side, with a panel member added to a X-X cross section of FIG. 8.

As illustrated in FIG. 10, the flap portion 254 is provided to protrude to the front side of the large rectangular portion 251. The back surface of the left flap portion 254 engages, and is guided by, the large rectangular portion 251 and a guide elongated protrusion 31 (see also FIG. 7) whose cross section is formed in a crank shape, whose corner portion is provided on the planar guide portion 30 of the panel member 3, and which is long in the vertical direction. A recess groove 254*a* extending in the vertical direction is formed on the back surface of the right flap portion 254, and the back surface of the right flap portion 254 is engaged with and guided by a guide elongated protrusion 32 (see also FIG. 7) and the recess groove 254*a*.

As illustrated in FIG. 6, a projected elongated protrusion 253 is provided along an edge of the small rectangular portion 252 from the front surface of the left and right flap portions 254. The left flap portion 254 includes a left second engaging portion 222 (second engaging portion 220) that protrudes beyond the lower end of the large rectangular portion 251 and protrudes to the left side. The left second engaging portion 222 includes an engaging recess portion 222*a*. The right flap portion 254 also includes a right second engaging portion 223 (second engaging portion 220) that protrudes beyond the lower end of the large rectangular portion 251 and protrudes to the right side. The right second engaging portion 223 is also provided with an engaging recess portion 223*a*. A second knob portion 230 having a semicircular protruding end with the plate surfaces oriented in the left and right direction is provided on the front surface of the flap portion 254 where the right second engaging portion 223 is provided.

The interlocking member 400 is provided to be movable in accordance with a slide operation of the second slide member 200. The interlocking member 400 of the embodiment of the present disclosure is movable by being provided to be swingable. For example, the interlocking member 400 can also be made movable, for example, by sliding in accordance with a slide operation of the second slide member 200. The interlocking member 400 includes a swinging member 410 and a cloud-shaped member 420 including a second display portion 421. The swinging member 410 and the cloud-shaped member 420 are connected at a fulcrum 430, and the swinging member 410 and the cloud-shaped member 420 are provided with a predetermined interval in the front and rear direction.

More specifically, as illustrated in the enlarged view of a part Q1 of FIG. 6 when viewing the fulcrum 430 from the back side of the cloud-shaped member 420, the fulcrum 430 is formed in such a shape that a cylindrical shaft portion 411 including a cutout portion 411*a* is erected forward from the swinging member 410, and a cylindrical shaft portion 422 erected rearward from the cloud-shaped member 420 engages the cutout portion 411*a*. Therefore, the cloud-shaped member 420 is relatively fixed to the swinging member 410. The swing member 410 and the cloud-shaped member 420 are connected only at the fulcrum 430. Therefore, at a location other than the fulcrum 430, an open space is formed between the swinging member 410 and the cloud-shaped member 420 with a predetermined space.

The swinging member 410 and the cloud-shaped member 420 integrally swing with a shaft portion 57 (see FIGS. 4 and 8) provided to protrude from the back side of the cover member 50 passing through the fulcrum 430 (cylindrical shaft portions 411 and 422). The shaft portion 57 passes through a shaft support portion 33 (see FIG. 7) of the planar guide portion 30 and is supported by a corresponding location of the rear roof portion 60.

Figure 7:
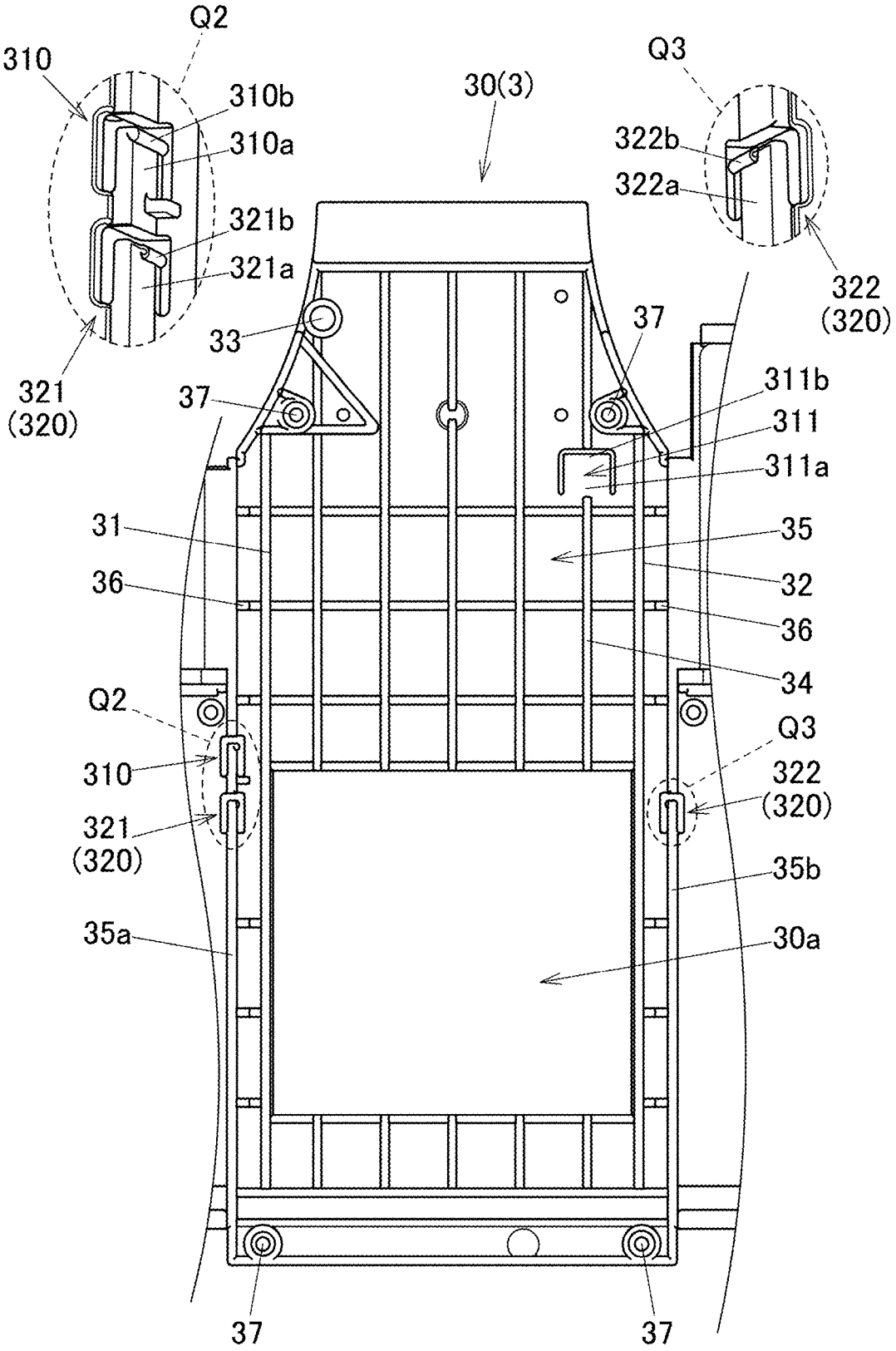
FIG. 7 is a front view illustrating a planar guide portion of the toy for figure play according to the embodiment of the present disclosure.

As illustrated in FIG. 7, the planar guide portion 30 provided on the panel member 3 is provided with a planar portion 35 with plate surfaces thereof facing in the front and rear direction, and the guide elongated protrusions 31 and 32 described above are provided on the left and right sides, respectively. The guide elongated protrusions 31 and 32 (guide portion) are provided long in the vertical direction. In the planar guide portion 30, a lattice-shaped reinforcing rib 34, which is formed to be lower in height than the guide elongated protrusions 31 and 32, is provided on the entire front surface of the planar portion 35. The left and right ends of the planar portion 35 are provided with a left guide wall portion 35*a* and a right guide wall portion 35*b*, which are erected on the front side to be orthogonal to the front surface of the planar portion 35. A plurality of guide ribs 36 (guide portion) are provided in a substantially triangular rib shape at the corner portions where the left guide wall portion 35*a* and the right guide wall portion 35*b* are connected with the planar portion 35 (see also FIG. 10).

A first movement regulating portion 310 is provided on the left guide wall portion 35*a*. As illustrated in the boxed diagram of part Q2 of FIG. 7, which illustrates an enlarged perspective view of the periphery of the first movement regulating portion 310, in the first movement regulating portion 310, a leaf spring portion 310*a* that can be elasticized in the left and right direction is formed by cutting out the periphery thereof in a U-shape, and a protrusion portion 310*b* that protrudes rightward is formed at the tip of the leaf spring portion 310*a*.

A left second movement regulating portion 321 as a second movement regulating portion 320 is provided on the left guide wall portion 35*a* directly below the first movement regulating portion 310. Similar to the first movement regulating portion 310, in the left second movement regulating portion 321, a leaf spring portion 321*a* and a protrusion portion 321*b* are formed. The protrusion portion 321*b* is formed on the rear side of the substantially center of the leaf spring portion 321*a* in the dimension in the front and rear direction, and corresponds only to the left second engaging portion 222 of the second slide member 200. A right second movement regulating portion 322 as the second movement regulating portion 320 is provided on the right guide wall portion 35*b* at the same position in the vertical direction as the left second movement regulating portion 321. As illustrated in the enlarged perspective view of part Q3 of FIG. 7, the right second movement regulating part 322 is formed in the same shape and symmetrical with the left second movement regulating part 321, and a leaf spring portion 322*a* and a protrusion portion 322*b* are formed in the right second movement regulating portion 322. The right second movement regulating portion 322 corresponds only to the right second engaging portion 223 of the second slide member 200.

An auxiliary first movement regulating portion 311 in which a leaf spring 311*a* is formed by cutting out the periphery thereof in a U-shape is provided at the upper right of the planar portion 35 of the planar guide portion 30. A protrusion portion 311*b* that protrudes forward is provided at a protruding end of the leaf spring 311*a*.

A plurality of connection boss portions 37 are provided on the planar portion 35 of the planar guide portion 30. The plurality of connection boss portions 37 are connected to a plurality of connection bosses 58 of the cover member 50 and are screwed together. On the planar portion 35 of the planar guide portion 30 of the panel member 3, at a position corresponding to the display window portion 53 of the cover member 50 in the assembled state, a third sub-display portion 30*a* which is slightly larger in size than the display window portion 53 and has a substantially rectangular shape that is slightly longer in the left and right direction is provided.

As illustrated in FIGS. 2 and 8 to 10, the second slide member 200 is provided on the back side of the first slide member 100. In the assembled state of the display portion 10, the left and right edges of the first slide member 100 are guided by a plurality of guide ribs 36 of the left guide wall portion 35*a* and the right guide wall portion 35*b*. The left flap portion 254 of the second slide member 200 is guided by the guide elongated protrusion 31, and the recess groove 254*a* of the right flap portion 254 is guided by the guide elongated protrusion 32. The first knob portion 120 of the first slide member 100 is inserted through the left guide slit 56*a* and guided, and the second knob portion 230 of the second slide member 200 is inserted through the right guide slit 56*b* and guided.

The guide rib 155 of the first slide member 100 comes into sliding contact with the rear edge of two left and right guide vertical ribs 560 (guide portion) (see FIG. 4) of the cover member 50 that are long in the vertical direction. An inner surface of the guide vertical rib 560 comes into sliding contact with an outer surface of the guided wall portion 153 of the first slide member 100. As such, by the planar guide portion 30 and the guide portion (guide ribs 36, guide elongated protrusions 31 and 32, guide slits 56, guide vertical ribs 560) of the cover member 50, the movement of the first slide member 100 and the second slide member 200 in the right and left direction and in the front and rear direction is regulated and is guided to be freely movable only in the vertical direction.

The projected elongated protrusion 253 of the second slide member 200 is in close proximity to or in sliding contact with the back surface of the flap portion 154 or the back surface of the support plate portion 130 of the first slide member 100, and positions the first slide member 100 and the second slide member 200 in the front and rear direction.

The second slide member 200 and the swinging member 410 are disposed at the same position in the front and rear direction. Therefore, the second slide member 200 and the swinging member 410 have a positional relationship in which the second slide member 200 (protruding portion 201) interferes with (contacts) the swinging member 410 when the second slide member 200 moves in the vertical direction. Meanwhile, the first slide member 100 has a positional relationship along the front and rear direction in which the first display portion 110 is disposed between the swinging member 410 and the cloud-shaped member 420, and the first display portion 110 is inserted between the swinging member 410 and the cloud-shaped member 420 (see FIG. 9).

Figure 9:
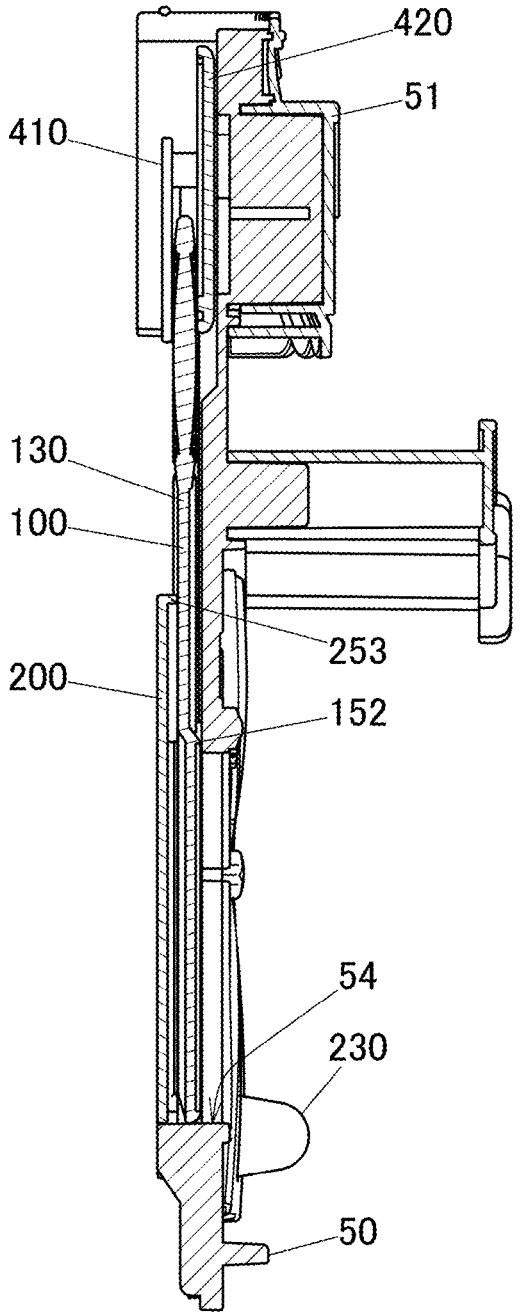
FIG. 9 is a cross-sectional view taken along line IX-IX in FIG. 8 of the toy for figure play according to the embodiment of the present disclosure.

The first slide member 100 and the second slide member 200 are positioned at the lower limit in FIGS. 1, 8, and 9. Here, as illustrated in FIG. 9, the lower end of the first slide member 100 and the lower end of the second slide member 200 come into contact with the upper surface of the regulating horizontal plate 54 of the cover member 50.

Figure 11:
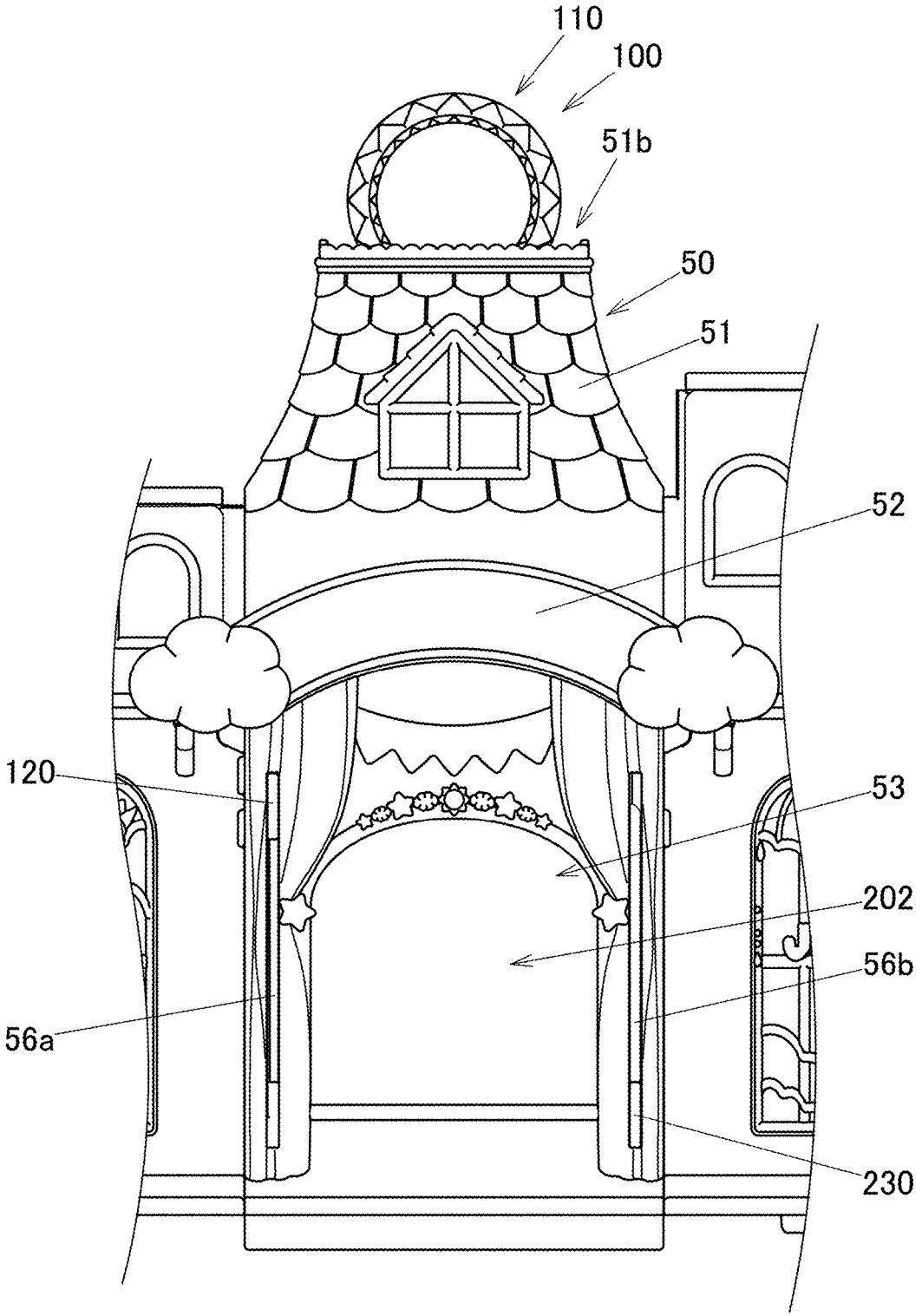
FIG. 11 is a front view of the display portion of the toy for figure play according to the embodiment of the present disclosure, illustrating a state in which the first slide member is positioned at an upper limit position and the second member is positioned at a lower limit position.
Figure 12:
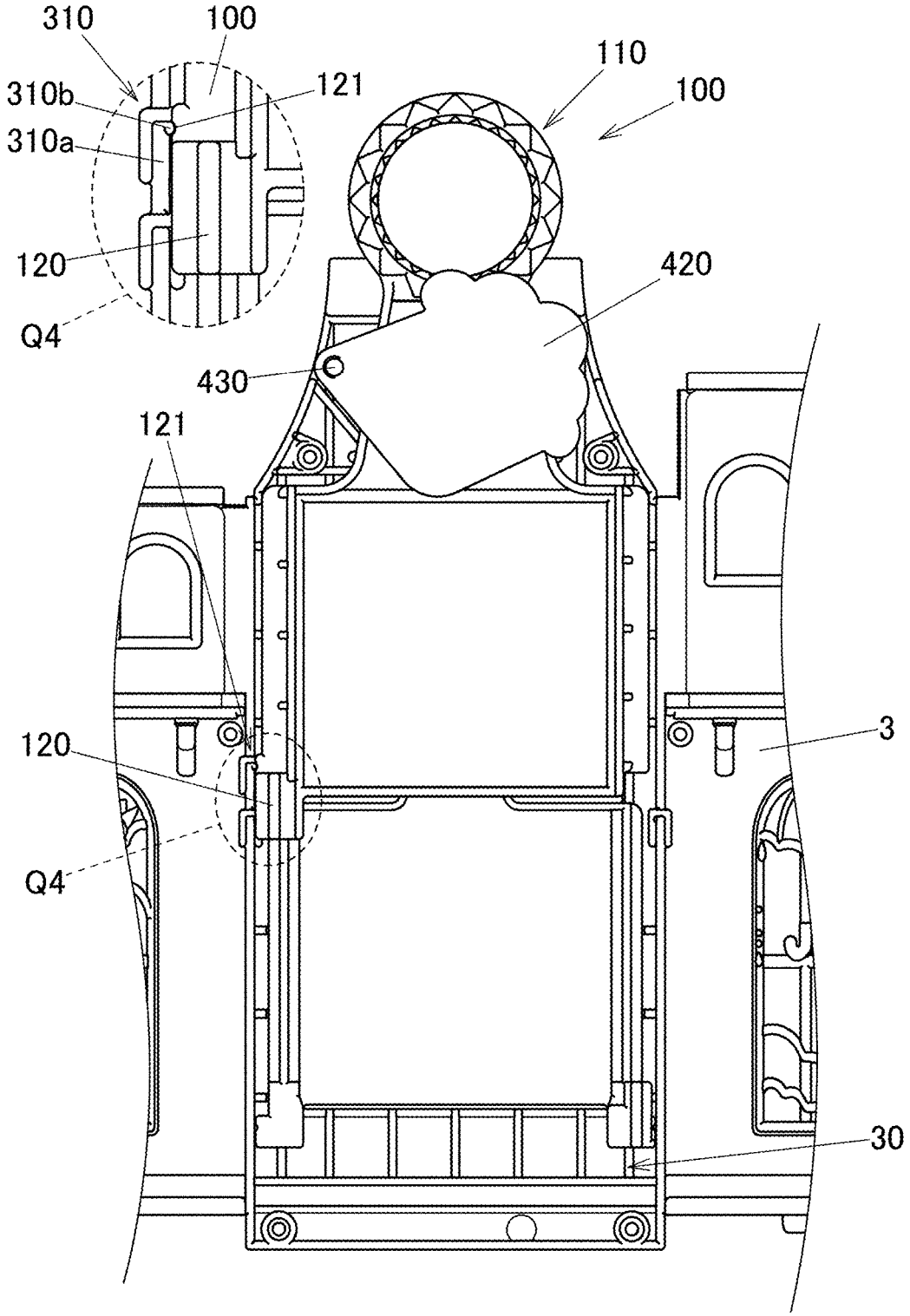
FIG. 12 is a front view illustrating the display portion of the toy for figure play according to the embodiment of the present disclosure in the state illustrated in FIG. 11, with the cover member omitted.

From here, as illustrated in FIG. 11, when the first knob portion 120 of the first slide member 100 is raised along the left guide slit 56*a*, the first display portion 110 of the first slide member 100 protrudes from the appearing/disappearing opening 51*b*. As illustrated in FIG. 12 and an enlarged box diagram of part Q4 of FIG. 12, at the upper limit position of the first slide member 100 where the first display portion 110 protrudes, the recessed first engaging portion 121 engages the protrusion portion 310*b* of the first movement restricting portion 310. Therefore, the first slide member 100 is regulated from moving upward. Since the right side of the first slide member 100 can press the first slide member 100 from the back side by the auxiliary first movement regulating portion 311 provided on the planar guide portion 30, the left and right sides are balanced.

When the first slide member 100 is positioned at the upper limit position and the second slide member 200 is positioned at the lower limit position, the second sub-display portion 202 of the second slide member 200 is exposed from the display window portion 53 of the cover member 50. The second sub-display portion 202 can be provided with a pattern related to the first display portion 110 by pasting a seal, for example. In the embodiment of the present disclosure, by providing a pattern on which a rainbow hangs over the blue sky on the second sub-display portion 202 in relation to the first display portion 110 that displays a sun-like image, it is possible to imagine and play the scene even more.

When the second knob portion 230 of the second slide member 200 is raised along the right guide slit 56*b* from the state where the first slide member 100 is positioned at the upper limit position and the second slide member 200 is positioned at the lower limit position, the protruding portion 201 of the second slide member 200 comes into contact with the swinging member 410 (see FIG. 15), and the swinging member 410 moves upward (counterclockwise) around the fulcrum 430 as the second slide member 200 rises. The cloud-shaped member 420 rotates and moves around the fulcrum 430 together with the swinging member 410, and protrudes from the appearing/disappearing opening 51*b*.

Figure 13:
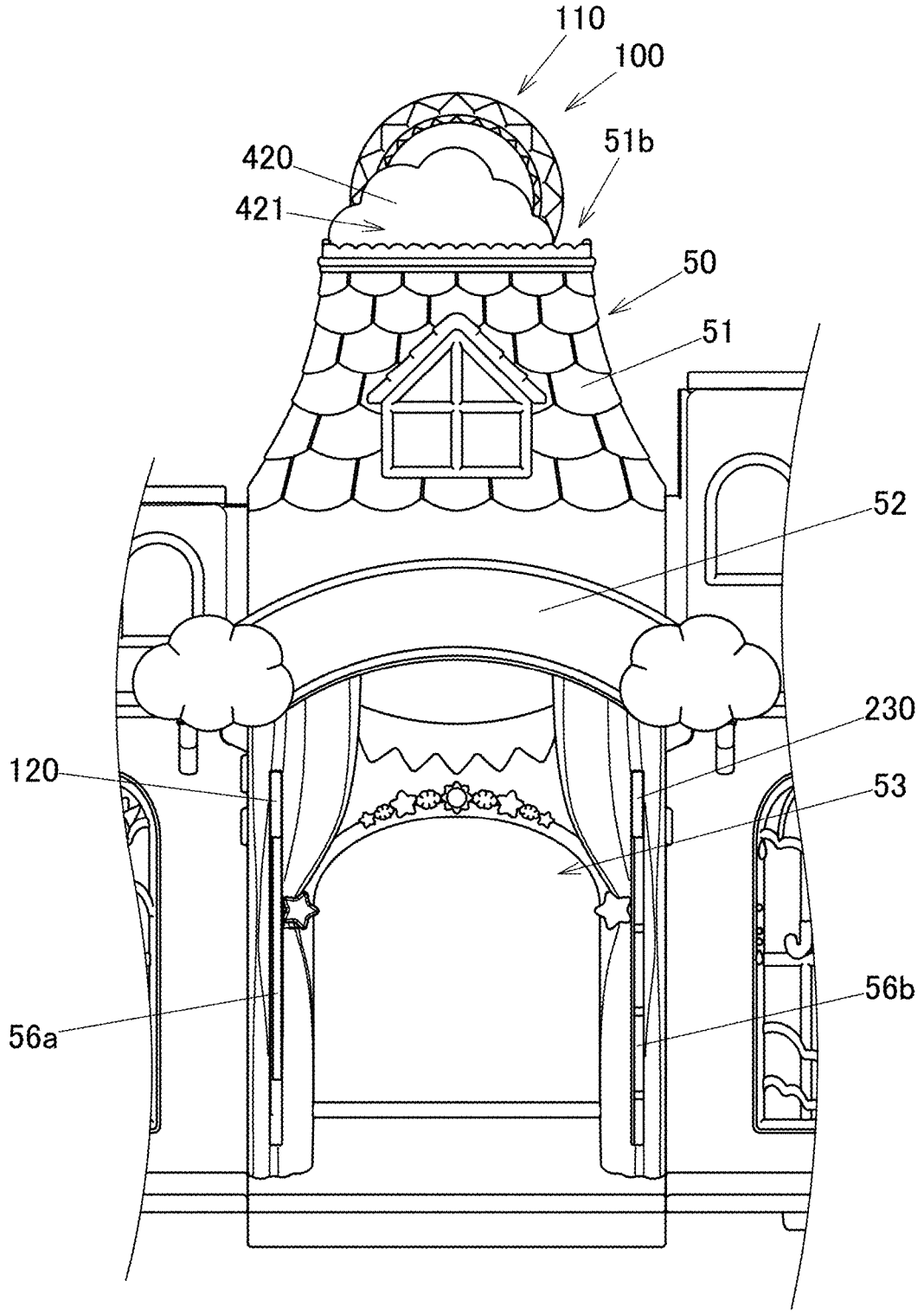
FIG. 13 is a front view of the display portion of the toy for figure play according to the embodiment of the present disclosure, illustrating a state in which both the first slide member and the second slide member are positioned at the upper limit position.

When the second slide member 200 reaches the upper limit position, as illustrated in FIG. 13, the cloud-shaped member 420 (second display portion 421) protrudes to the front side of the first display portion 110 and is positioned to hide about half of the first display portion 110, and thus a state in which the sun is covered with clouds appears.

Figure 14:
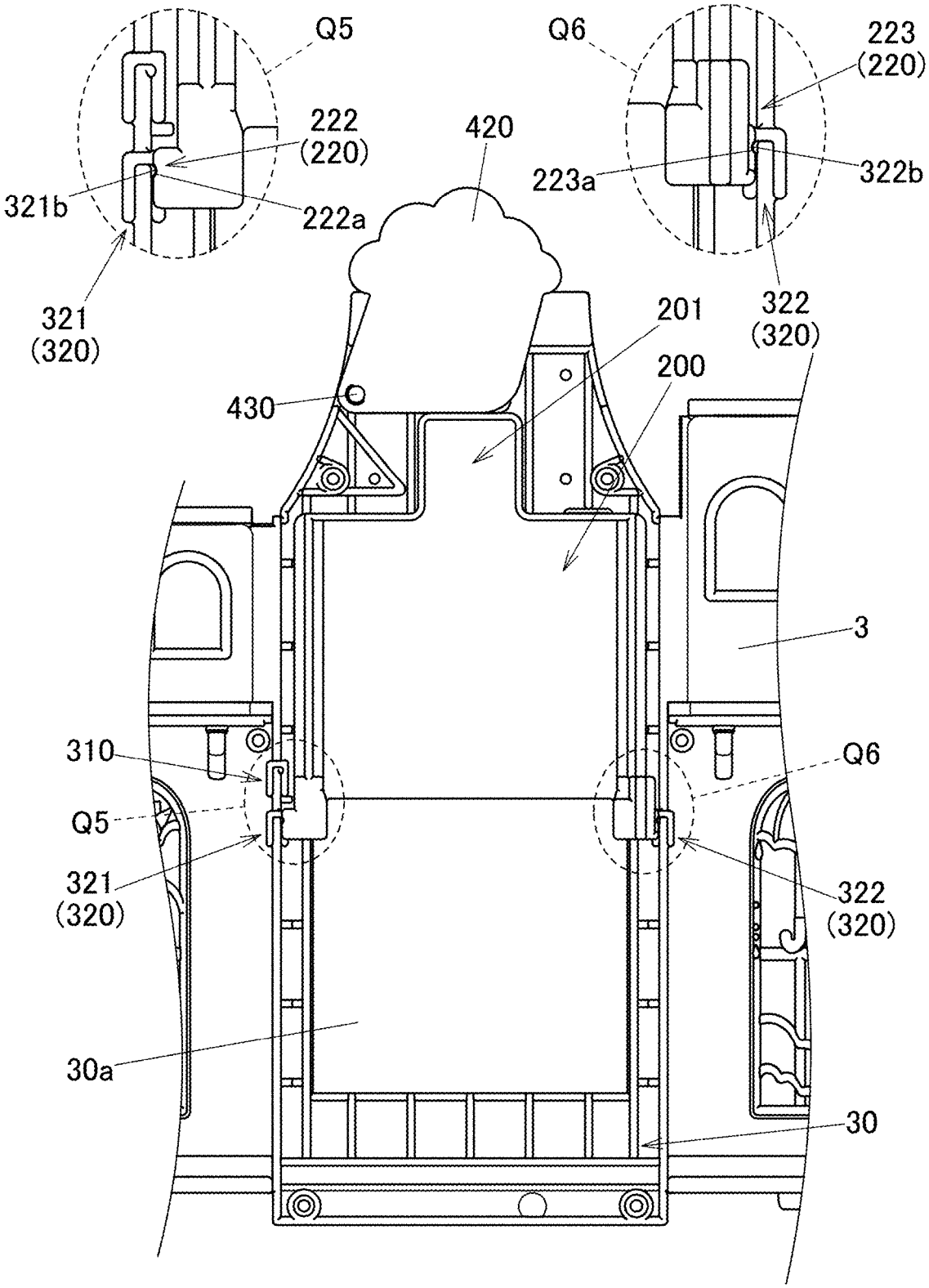
FIG. 14 is a front view illustrating the display portion of the toy for figure play according to the embodiment of the present disclosure in the state illustrated in FIG. 13, with the cover member and the first slide member omitted.

As illustrated in FIG. 14 and the enlarged encircled diagrams of parts Q5 and Q6 of FIG. 14, at the upper limit position of the second slide member 200, the protrusion portion 321*b* of the left second movement regulating portion 321 of the second movement regulating portion 320 engages the engaging recess portion 222*a* of the left second engaging portion 222 of the second engaging portion 220 in a protrusion-recess manner. Similarly, the protrusion portion 322*b* of the right second movement regulating portion 322 of the second movement regulating portion 320 engages the engaging recess portion 223*a* of the right second engaging portion 223 of the second engaging portion 220 in a protrusion-recess manner. The upward movement of the second slide member 200 is regulated by the protrusion-recess engagement between the second movement regulating portion 320 and the second engaging portion 220.

When the first slide member 100 and the second slide member 200 are both positioned at the upper limit position, the third sub-display portion 30*a* of the planar guide portion 30 is exposed from the display window portion 53 of the cover member 50. The third sub-display portion 30*a* can be provided with a pattern related to the first display portion 110 and the second display portion 421 by pasting a seal, for example. In the present embodiment, it is desirable to provide a display indicating cloudy weather or rainy weather in the third sub-display portion 30*a* in relation to the state where clouds hang over the sun.

Figure 15:
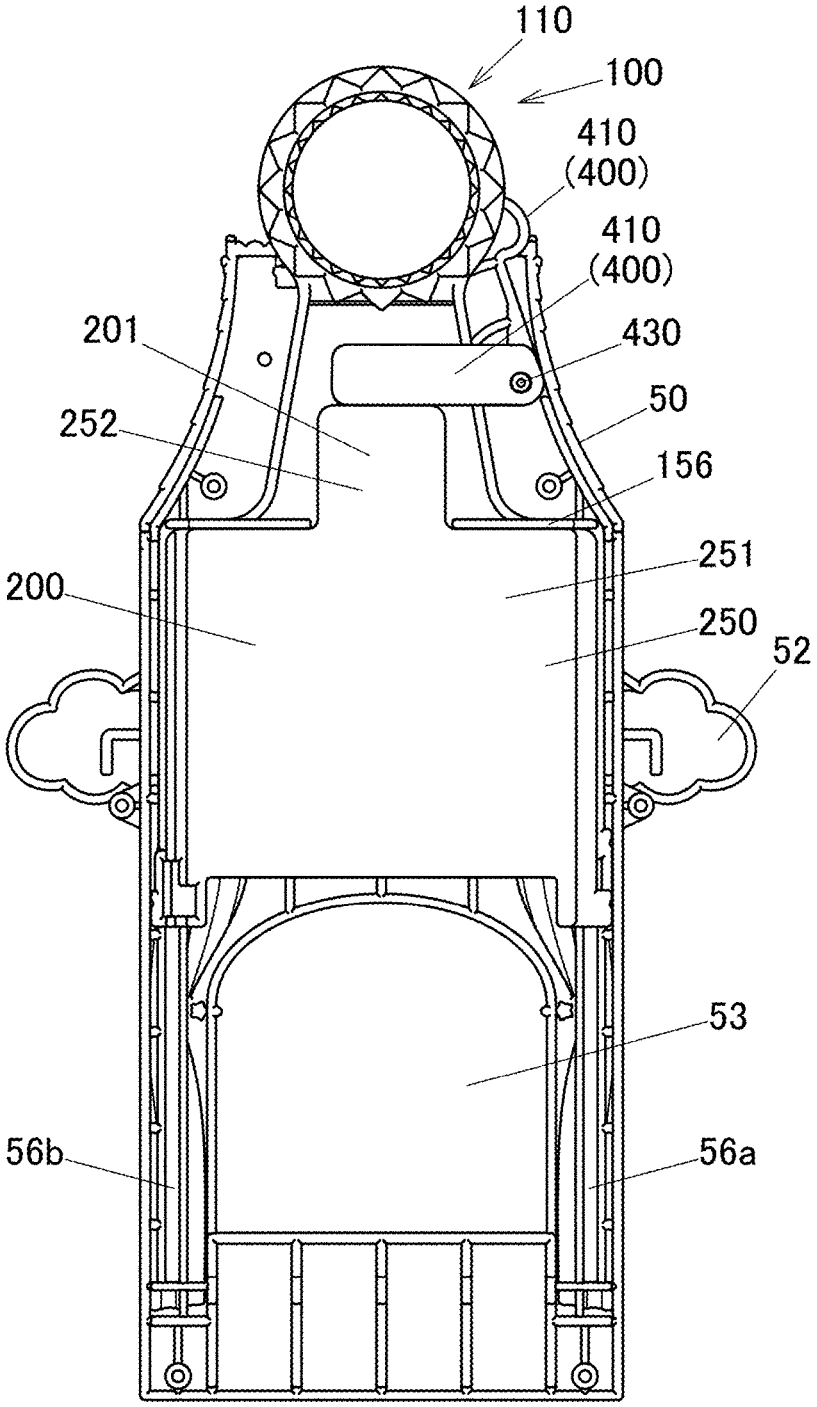
FIG. 15 is a back view of the display portion of the toy for figure play according to the embodiment of the present disclosure with a panel member omitted, illustrating the state in which both the first slide member and the second slide member are positioned at the upper limit position.

When both the first slide member 100 and the second slide member 200 are positioned at the upper limit position, as illustrated in FIG. 15, the upper edge of the large rectangular portion 251 of the main body portion 250 of the second slide member 200 comes into contact with the lower surface of the engaging abutting portion 156 provided on the back surface of the first slide member 100. From here, when the first knob portion 120 of the first slide member 100 is lowered down along the left guide slit 56*a*, the first slide member 100 can slide downward together with the second slide member 200 to reach the state illustrated in FIG. 1, FIG. 8, and the like.

When the first slide member 100 and the second slide member 200 are both positioned at the lower limit position, the first sub-display portion 101 of the first slide member 100 is exposed from the display window portion 53. In the embodiment of the present disclosure, the first sub-display portion 101 can be provided with a pattern for imaging nighttime when the sun is not out. If the second knob portion 230 of the second slide member 200 is lifted upward when the first slide member 100 and the second slide member 200 are both positioned at the lower limit position, since the upper edge of the large rectangular portion 251 of the main body portion 250 of the second slide member 200 is in contact with the lower surface of the engaging abutting portion 156 provided on the back surface of the first slide member 100, the first slide member 100 can be slid upward together with the second slide member 200 to reach the upper limit position.

Figure 16:
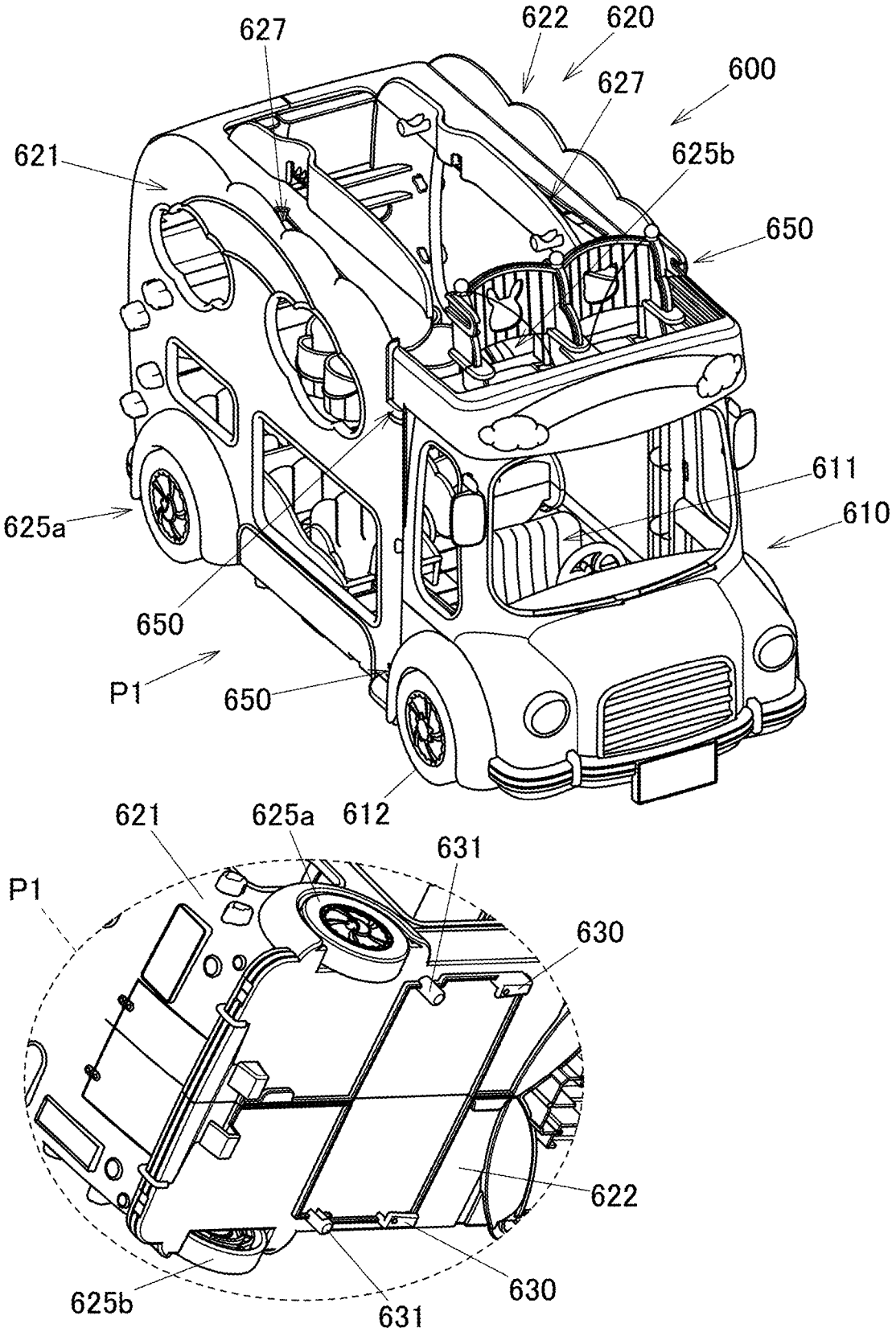
FIG. 16 is a perspective view illustrating a traveling toy for figure play to be combined with the toy for figure play according to the embodiment of the present disclosure.

The toy for figure play 1 can also be played in combination with other toys for figure play. For example, FIG. 16 illustrates a traveling toy for figure play 600 having a form to imitate a bus. The traveling toy for figure play 600 includes a front portion 610 of a vehicle including a driver's seat 611 and front wheels 612, and a passenger compartment portion 620. The passenger compartment portion 620 includes a left passenger compartment 621 and a right passenger compartment 622. The left passenger compartment 621 and the right passenger compartment 622 include wheels 625*a* and 625*b*, which are rear wheels, respectively.

Figure 17:
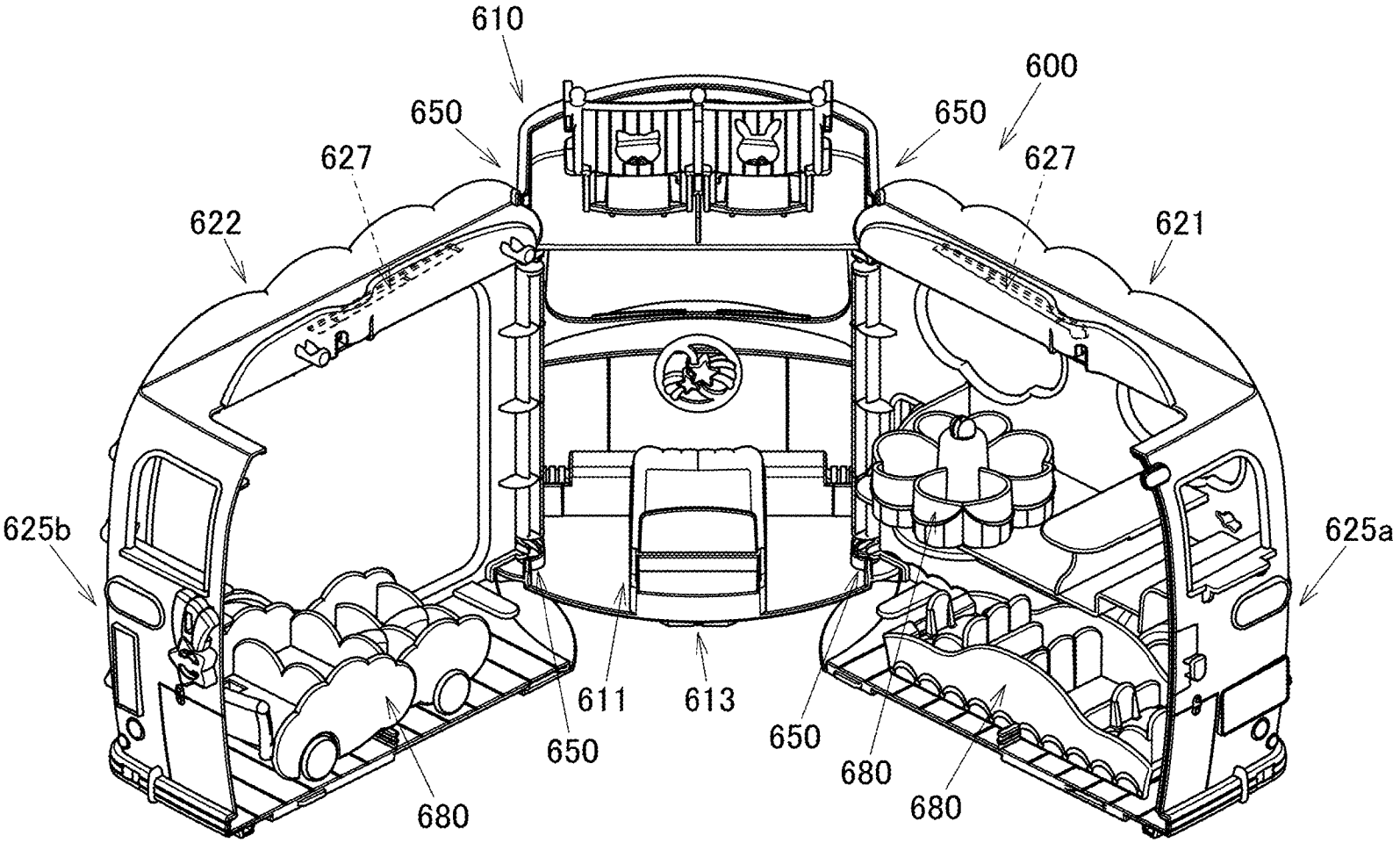
FIG. 17 is a perspective view of the traveling toy for figure play to be combined with the toy for figure play according to the embodiment of the present disclosure, illustrating a state in which a passenger compartment portion is opened.

As illustrated in FIGS. 16 and 17, the left passenger compartment 621 and the right passenger compartment 622 of the passenger compartment portion 620 are connected to the front portion 610 through a hinge portion 650, so that the left and right passenger compartment portions 621 and 622 can be opened and closed to the left and right. As illustrated in part P1 when viewed from the bottom of FIG. 16, sandwiching engaging portions 630 and support posts 631 are provided on each of the lower surfaces of the left passenger compartment 621 and the right passenger compartment 622. Each sandwiching engaging portion 630 is formed in a hook shape toward the inside (the side opposite to the outside to which the wheels 625*a* and 625*b* are attached).

Figure 18:
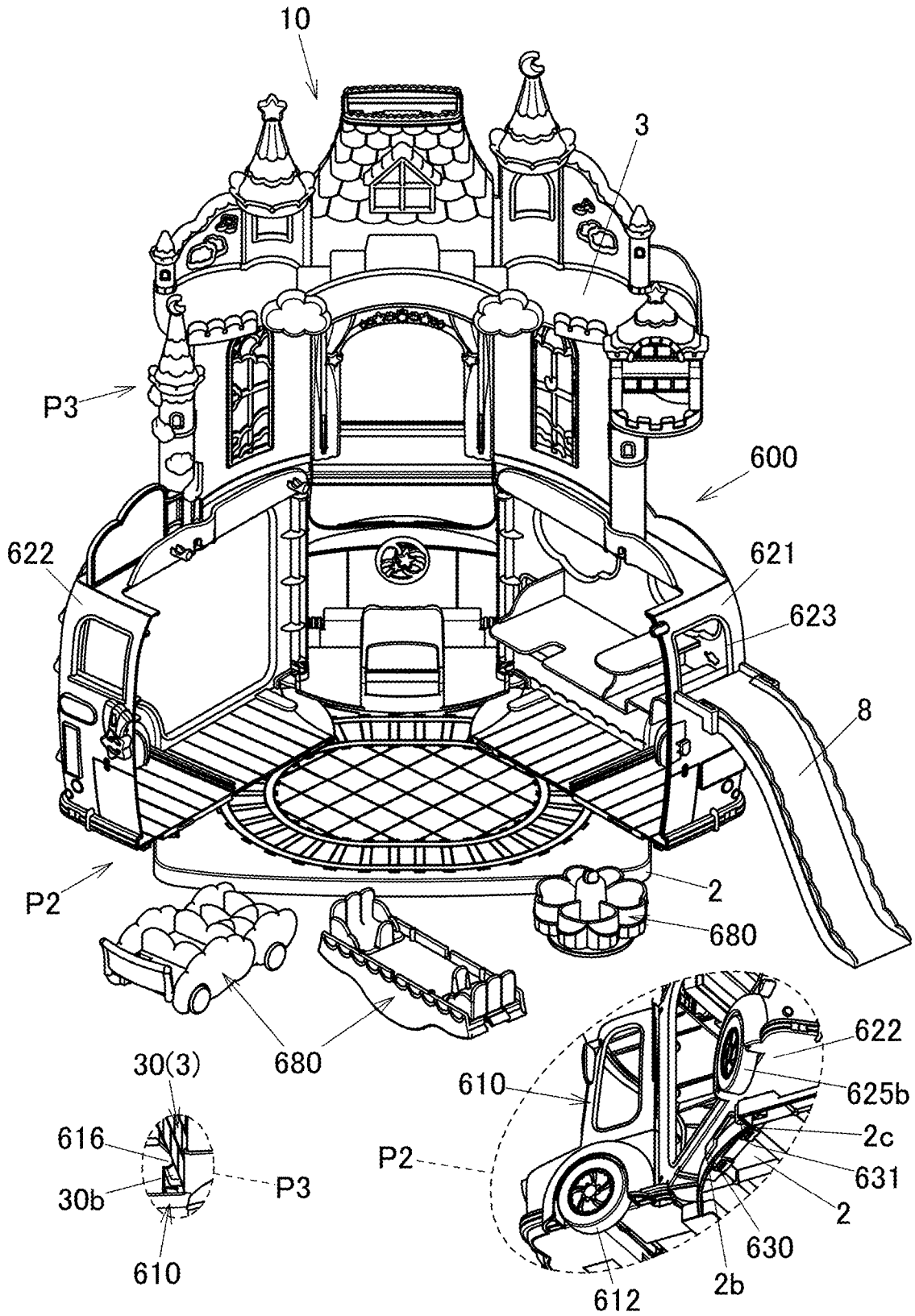
FIG. 18 is a diagram illustrating a state in which the toy for figure play and the traveling toy for figure play according to the embodiment of the present disclosure are combined.

As illustrated in FIG. 18, the toy for figure play 1 can be combined with the traveling toy for figure play 600. To combine the toy for figure play 1 and the traveling toy for figure play 600, first, a protrusion 613 (see FIG. 17) protruding from a lower surface of a bottom plate of the driver's seat 611 of the traveling toy for figure play 600 is fitted into the recess portion 2*a* on the rear side of the base member 2. Then, as illustrated in a diagram when viewed from part P2 of FIG. 18, the sandwiching engaging portions 630 are engaged with recessed sandwiching engaged portions 2*b* (see FIG. 2) respectively provided on the left and right sides of the base member 2 of the toy for figure play 1. Here, the support posts 631 come into contact with corners of corner portions 2*c* near the sandwiching engaged portion 2*b*, and the passenger compartment portion 620 is aligned with the base member 2. As such, the panel member 3 is disposed on the upper part of the passenger compartment portion 620. Next, as illustrated in the diagram when viewed from part P3, an engaging protrusion 30*b* protruding to the back side of the lower end of the planar guide portion 30 of the panel member 3 is hooked onto a hook-shaped portion 616 provided on the upper part of the front portion 610 of the traveling toy for figure play 600 (see also FIG. 17). Then, the plurality of protruding portions 3*a* (connecting engaged portions) are fitted into a plurality of holes 627 (connecting engaging portions) provided on the upper part of the passenger compartment portion 620 corresponding to the plurality of protruding portions 3*a*.

The slide 8 can be connected to a rear window 623 of the left passenger compartment 621 of the passenger compartment portion 620. An independent toy for figure play 680 such as a seesaw provided in the passenger compartment 620 to allow figure play to be performed independently can be disposed around the toy for figure play 1 combined with the traveling toy for figure play 600, and played with independently.

According to the embodiments of the present disclosure as described above, a toy for figure play according to the following aspects can be provided.

A toy for figure play according to a first aspect includes: a guide portion; a first slide member configured to be guided by the guide portion, the first slide member including a first knob portion and a first display portion; a second slide member configured to be guided by the guide portion, the second slide member being provided on a back side of the first slide member and including a second knob portion, and an interlocking member provided to be movable in accordance with a slide operation of the second slide member, the interlocking member including a second display portion disposed on a front side of the first display portion.

According to such configuration, by sliding the second slide member disposed on the back side of the first slide member, the second display portion of the second slide portion can be made to appear or disappear on the front side of the first display portion of the first slide member, and a display appears on a front side even when a member on a rear side is operated, and thus the mode of change is interesting, and the manual operation for changing the display can be made enjoyable.

The toy for figure play according to a second aspect further includes a cover member provided on a front side of the first slide member to allow the first display portion and the second display portion to appear and disappear.

According to such configuration, the first slide member and the second slide member can be slid to make the first display portion and the second display portion appear and disappear from the cover member.

In the toy for figure play according to a third aspect, the first slide member includes a first engaging portion, the second slide member includes a second engaging portion, and the guide portion includes: a first movement regulating portion configured to be engaged with the first engaging portion at a position where the first display portion protrudes from the cover member to regulate sliding movement of the first slide member; and a second movement regulating portion configured to be engaged with the second engaging portion at a position where the second display portion protrudes from the cover member to regulate sliding movement of the second slide member.

According to such configuration, the first display portion and the second display portion can be held in a protruding state or in a retracted state.

In the toy for figure play according to a fourth aspect, the first slide member includes a first sub-display portion, the second slide member includes a second sub-display portion, a panel member including a third sub-display portion is provided on a back side of the second slide member, and the cover member includes a display window portion that opens to allow the first sub-display portion, the second sub-display portion, and the third sub-display portion to be selectively displayed therethrough.

According to such configuration, the first sub-display portion can be displayed from the display window portion in a state where the first display portion and the second display portion are retracted, the second sub-display portion can be displayed from the display window portion in a state where only the first display portion is protruded, and the third sub-display portion can be displayed from the display window portion in a state where the first display portion and the second display portion are protruded.

In the toy for figure play according to a fifth aspect, the interlocking member is provided to be swingable.

According to such configuration, with a simple configuration in which the interlocking member is provided with a fulcrum, the interlocking member can be reliably movable in accordance with the slide operation of the second slide member.

In the toy for figure play according to a sixth aspect, the first slide member includes an engaging abutting portion configured to contact the second slide member to allow the first slid member to slide together with the second slide member.

According to such configuration, the second slide member can also be slid simultaneously with the slide operation of the first slide member. For example, in a state where both the first display portion of the first slide member and the second display portion of the second slide member protrude from the cover member, the second display portion of the second slide member can also be retracted only by operating the first slide member.

The toy for figure play according to a seventh aspect further includes a base member and a panel member that includes the guide portion, the panel member surrounding a part of the base member.

According to such configuration, the base member is formed in a plate shape that imitates an indoor floor, for example, and the panel member is formed in a shape that imitates a nursery school building, for example, so that the toy for figure play can be played in a form that imitates a nursery school.

The toy for figure play according to an eighth aspect further includes a traveling toy for figure play provided with a passenger compartment portion configured to open and close in a right and left direction, in which the panel member includes a connecting engaged portion configured to be vertically engaged with a connecting engaging portion provided on an upper part of the passenger compartment portion, and the base member includes a sandwiching engaged portion configured to be laterally engaged with a sandwiching engaging portion provided in the passenger compartment portion when the base member is disposed to be sandwiched by the passenger compartment portion in a state in which the passenger compartment portion is opened.

According to such configuration, by combining the toy for figure play and the traveling toy for figure play, it is possible to provide a large-scale toy for figure play having various play functions.

Although the embodiments of the present disclosure have been described above, the present disclosure is not limited to the embodiments described above, and various changes can be made thereto without departing from the scope of the present disclosure.

What is claimed is:

1. A toy for figure play comprising:

a guide portion;

a first slide member configured to be guided by the guide portion, the first slide member comprising a first knob portion and a first display portion;

a second slide member configured to be guided by the guide portion, the second slide member being provided on a back side of the first slide member and comprising a second knob portion; and an interlocking member provided to be movable in accordance with a slide operation of the second slide member, the interlocking member comprising a second display portion disposed on a front side of the first display portion, wherein the first slide member comprises an engaging abutting portion configured to contact the second slide member to allow the first slid member to slide together with the second slide member.

2. The toy for figure play according to claim 1, further comprising:

a cover member provided on a front side of the first slide member to allow the first display portion and the second display portion to appear and disappear.

3. The toy for figure play according to claim 2, wherein the first slide member comprises a first engaging portion, wherein the second slide member comprises a second engaging portion, and wherein the guide portion comprises:

a first movement regulating portion configured to be engaged with the first engaging portion at a position where the first display portion protrudes from the cover member to regulate sliding movement of the first slide member; and a second movement regulating portion configured to be engaged with the second engaging portion at a position where the second display portion protrudes from the cover member to regulate sliding movement of the second slide member.

4. The toy for figure play according to claim 2, wherein the first slide member comprises a first sub-display portion, wherein the second slide member comprises a second sub-display portion, wherein a panel member comprising a third sub-display portion is provided on a back side of the second slide member, and wherein the cover member comprises a display window portion that opens to allow the first sub-display portion, the second sub-display portion, and the third sub-display portion to be selectively displayed therethrough.

5. The toy for figure play according to claim 1, wherein the interlocking member is provided to be swingable.

6. The toy for figure play according to claim 1, further comprising:

a base member; and a panel member comprising the guide portion, the panel member surrounding a part of the base member.

7. The toy for figure play according to claim 6, further comprising:

a traveling toy for figure play comprising a passenger compartment portion configured to open and close in a right and left direction, wherein the panel member comprises a connecting engaged portion configured to be vertically engaged with a connecting engaging portion provided on an upper part of the passenger compartment portion, and wherein the base member comprises a sandwiching engaged portion configured to be laterally engaged with a sandwiching engaging portion provided in the passenger compartment portion when the base member is disposed to be sandwiched by the passenger compartment portion in a state in which the passenger compartment portion is opened.

* * * * *